US006438494B1

(12) United States Patent
Yamamoto et al.

(10) Patent No.: US 6,438,494 B1
(45) Date of Patent: Aug. 20, 2002

(54) METHOD, APPARATUS AND PROGRAM PRODUCTS FOR DESIGNING ROADS

(75) Inventors: Tadashi Yamamoto, Hiroshima; Eihachirou Nakamae, Higashi-hiroshima, both of (JP)

(73) Assignee: Sanei Co., Ltd., Hiroshima (JP)

( * ) Notice: Subject to any disclaimer, the term of this patent is extended or adjusted under 35 U.S.C. 154(b) by 134 days.

(21) Appl. No.: 09/684,321

(22) Filed: Oct. 10, 2000

(30) Foreign Application Priority Data

Oct. 12, 1999 (JP) ..... 11-289048

(51) Int. Cl.[7] ..... G06F 19/00
(52) U.S. Cl. ..... 702/5; 701/207; 701/208
(58) Field of Search ..... 702/5; 701/207, 701/208

(56) References Cited

FOREIGN PATENT DOCUMENTS

JP 10-198724 7/1998

WO 93/17392 9/1993

OTHER PUBLICATIONS

L. I. Hewes: "American Highway Practice (vol. 1)", 1946, John Wiley & Sons, New York,, XP002156714 * p. 105–p. 121*.

*Primary Examiner*—Edward Lefkowitz
*Assistant Examiner*—Anthony Gutierrez
(74) *Attorney, Agent, or Firm*—Wenderoth, Lind & Ponack, L.L.P.

(57) ABSTRACT

An apparatus for designing roads has an input unit for inputting information of design conditions and/or a command of design processing and so on, an input control unit for controlling the input unit, a design conditions database for storing data such as the information of the design conditions, a road design processing unit for executing road design in accordance with the command of the design processing and/or the information of the design conditions, a result database for storing a data file such as a road design map, an image data processing unit for converting the data file such as the road design map into a suitable output format, an output unit for outputting the road design map as three dimensional computer graphics and/or printer papers and an output control unit for controlling the output unit.

12 Claims, 8 Drawing Sheets

METHOD, APPARATUS AND PROGRAM PRODUCTS FOR DESIGNING ROADS

FIELD OF THE INVENTION

This invention relates to a method and an apparatus for designing roads, and more particularly to, a method and an apparatus for designing roads which enable to generate clothoid curves without executing exceptional processing near clothoid origins, in case of generating curvature transition curves of the roads using the clothoid curves.

BACKGROUND OF THE INVENTION

In order to design roads, not only line segments and circular arcs but also curves, that is curvature transition curves, for linking the line segments and the circular arcs, which are inserted at the point where curvatures vary, are required. It is regulated to use the curvature transition curves on highly standardized roads such as express highways by the road structure ordinance. Clothoid curves are usually used as the curvature transition curves.

A clothoid curve (Cornu Spiral) is a curve whose curvature is directly proportional to its arc length. The curve, which has a peculiar characteristic, is employed in linking circular arcs together, line segments together, and a circular arc and a line segment from of old. And recently, the clothoid curve is generated by using a computer such as a personal computer.

In the conventional method for designing roads using clothoid curves which are generated by using a computer such as a personal computer, however, there are disadvantages in that exceptional processing is required for calculating coordinates (X, Y) near a clothoid origin, the calculation of an intersection of lines (roads) can not be executed in case the intersection of the lines (the roads) comes to near a clothoid origin, and the calculation of the shortest distance (the length of a perpendicular line) from a road centerline to an arbitrary point can not be executed in case the perpendicular line passes near a clothoid origin, because in case of calculating the coordinates (X, Y) near the clothoid origin, the calculation results become indefinite, that is to say, the coordinates near the clothoid origin can not be calculated And more, the exceptional processing causes slow execution speed and complicated processing, and obstructs unified processing by using parameters, the real length of which compound curves are used as roads.

Moreover, in case the calculation of the shortest distance can not be executed, the road design can not be executed easily.

SUMMARY OF THE INVENTION

Accordingly, it is an object of the invention to provide a method and an apparatus for designing roads, which enable to generate clothoid curves without executing exceptional processing near clothoid origins, in case of generating curvature transition curves of the roads using the clothoid curves.

According to the first feature of the invention, an apparatus for designing roads, which is an apparatus for designing roads using line segments, circular arcs, clothoid curves and so on, comprises input means for inputting information of design conditions and/or a command of design processing and so on, design conditions storage means for storing the information of the design conditions input by the input means, road design processing means for executing road design in accordance with the command of the design processing input by the input means and/or the information of the design conditions stored in the design conditions storage means and for generating a road design map, and output means for outputting the road design map generated by the road design processing means, wherein the road design processing means generates a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty} (-1)^n \frac{l^{4n+1}}{(4n+1)\cdot 2^{2n}\cdot (2n)!} \qquad \text{(Equation 1)}$$

$$y = \sum_{n=0}^{\infty} (-1)^n \frac{l^{4n+3}}{(4n+3)\cdot 2^{2n+1}\cdot (2n+1)!}$$

where "l" is the unit clothoid arc length, "x" and "y" is the coordinate of the arc length "l" from the clothoid origin of the unit clothoid curve, and "n" is order.

According to the second feature of the invention, an apparatus for designing roads, which is an apparatus for designing roads using line segments, circular arcs, clothoid curves and so on, comprises input means for inputting information of design conditions and/or a command of design processing and so on, design conditions storage means for storing the information of the design conditions input by the input means, road design processing means for executing road design in accordance with the command of the design processing input by the input means and/or the information of the design conditions stored in the design conditions storage means and for generating a road design map, result storage means for storing the road design map generated by the road design processing means, and output means for outputting the road design map stored by the result storage means, wherein the road design processing means generates a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty} (-1)^n \frac{l^{4n+1}}{(4n+1)\cdot 2^{2n}\cdot (2n)!} \qquad \text{(Equation 1)}$$

$$y = \sum_{n=0}^{\infty} (-1)^n \frac{l^{4n+3}}{(4n+3)\cdot 2^{2n+1}\cdot (2n+1)!}$$

where "l" is the unit clothoid arc length, "x" and "y" is the coordinate of the arc length "l" from the clothoid origin of the unit clothoid curve, and "n" is order.

According to the third feature of the invention, an apparatus for designing roads comprises road design processing means for generating a clothoid curve using the following relation equation (2) of a "n" term (Tx(n), Ty(n)), which is deduced by expanding "x" and "y" of the recurrence equation (1) in a series, expressed as $$Tx(n+1) = -\frac{(4n+1)\cdot l^4}{4\cdot(4n+5)\cdot(2n+2)\cdot(2n+1)}Tx(n) \quad (n = 0, 1, 2, \ldots) \qquad \text{(Equation 2)}$$

$$Tx(0) = l$$

$$Ty(n+1) = -\frac{(4n+3)\cdot l^4}{4\cdot(4n+7)\cdot(2n+3)\cdot(2n+2)}Ty(n) \quad (n = 0, 1, 2, \ldots)$$

$$Ty(0) = \frac{l^3}{3\cdot 2}$$

According to the forth feature of the invention, a method for designing roads comprises the steps of (A) storing input information of design conditions, (B) executing road design in accordance with an input command of design processing and/or the stored information of the design conditions and generating a road design map using line segments, circular arcs, clothoid curves and so on, and (C) outputting the generated road design map, wherein the step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is the coordinate of the arc length "l" from the clothoid origin of the unit clothoid curve, and "n" is order.

According to the fifth feature of the invention, a method for designing roads comprises the steps of (A) storing input information of design conditions, (B) executing road design in accordance with an input command of design processing and/or the stored information of the design conditions and generating a road design map using line segments, circular arcs, clothoid curves and so on, (C) storing the generated road design map, and (D) outputting the stored road design map, wherein the step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is the coordinate of the arc length "l" from the clothoid origin of the unit clothoid curve, and "n" is order.

According to the sixth feature of the invention, a method for designing roads comprises the step of (B) generating a clothoid curve using the following relation equation (2) of a "n" term (Tx(n), Ty(n)), which is deduced by expanding "x" and "y" of the recurrence equation (1) in a series, expressed as $$Tx(n+1) = -\frac{(4n+1)\cdot l^4}{4\cdot(4n+5)\cdot(2n+2)\cdot(2n+1)}Tx(n) \quad (n = 0, 1, 2, \ldots) \qquad \text{(Equation 2)}$$

$$Tx(0) = l$$

$$Ty(n+1) = -\frac{(4n+3)\cdot l^4}{4\cdot(4n+7)\cdot(2n+3)\cdot(2n+2)}Ty(n) \quad (n = 0, 1, 2, \ldots)$$

$$Ty(0) = \frac{l^3}{3\cdot 2}$$

According to the seventh feature of the invention, program products for designing roads, which is executed by computer system, comprises the steps of (A) storing input information of design conditions, (B) executing road design in accordance with an input command of design processing and/or the stored information of the design conditions and generating a road design map using line segments, circular arcs, clothoid curves and so on, and (C) outputting the generated road design map, wherein the step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is the coordinate of the arc length "l" from the clothoid origin of the unit clothoid curve, and "n" is order.

According to the eighth feature of the invention, program products for designing roads, which is executed by computer system, comprises the steps of (A) storing input information of design conditions, (B) executing road design in accordance with an input command of design processing and/or the stored information of the design conditions and generating a road design map using line segments, circular arcs, clothoid curves and so on, (C) storing the generated road design map, and (D) outputting the stored road design map, wherein the step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty} (-1)^n \frac{l^{4n+1}}{(4n+1)\cdot 2^{2n}\cdot(2n)!} \quad \text{(Equation 1)}$$

$$y = \sum_{n=0}^{\infty} (-1)^n \frac{l^{4n+3}}{(4n+3)\cdot 2^{2n+1}\cdot(2n+1)!}$$

where "l" is the unit clothoid arc length, "x" and "y" is the coordinate of the arc length "l" from the clothoid origin of the unit clothoid curve, and "n" is order.

According to the ninth feature of the invention, program products for designing roads comprises the step of (B) generating a clothoid curve using the following relation equation (2) of a "n" term (Tx(n), Ty(n)), which is deduced by expanding "x" and "y" of the recurrence equation (1) in a series, expressed as $$Tx(n+1) = -\frac{(4n+1)\cdot l^4}{4\cdot(4n+5)\cdot(2n+2)\cdot(2n+1)} Tx(n) \quad \text{(Equation 2)}$$

$$(n = 0, 1, 2, \ldots)$$

$$Tx(0) = l$$

$$Ty(n+1) = -\frac{(4n+3)\cdot l^4}{4\cdot(4n+7)\cdot(2n+3)\cdot(2n+2)} Ty(n)$$

$$(n = 0, 1, 2, \ldots)$$

$$Ty(0) = \frac{l^3}{3\cdot 2}$$

BRIEF DESCRIPTION OF THE DRAWINGS

The invention will be described in more detail in conjunction with the appended drawings, wherein.

DETAILED DESCRIPTION OF THE PREFERRED EMBODIMENTS

Before explaining a method and an apparatus for designing roads in the preferred embodiment according to the invention, the aforementioned conventional method and apparatus for designing roads will be explained in FIGS. 1 to 5.

Figure 1:
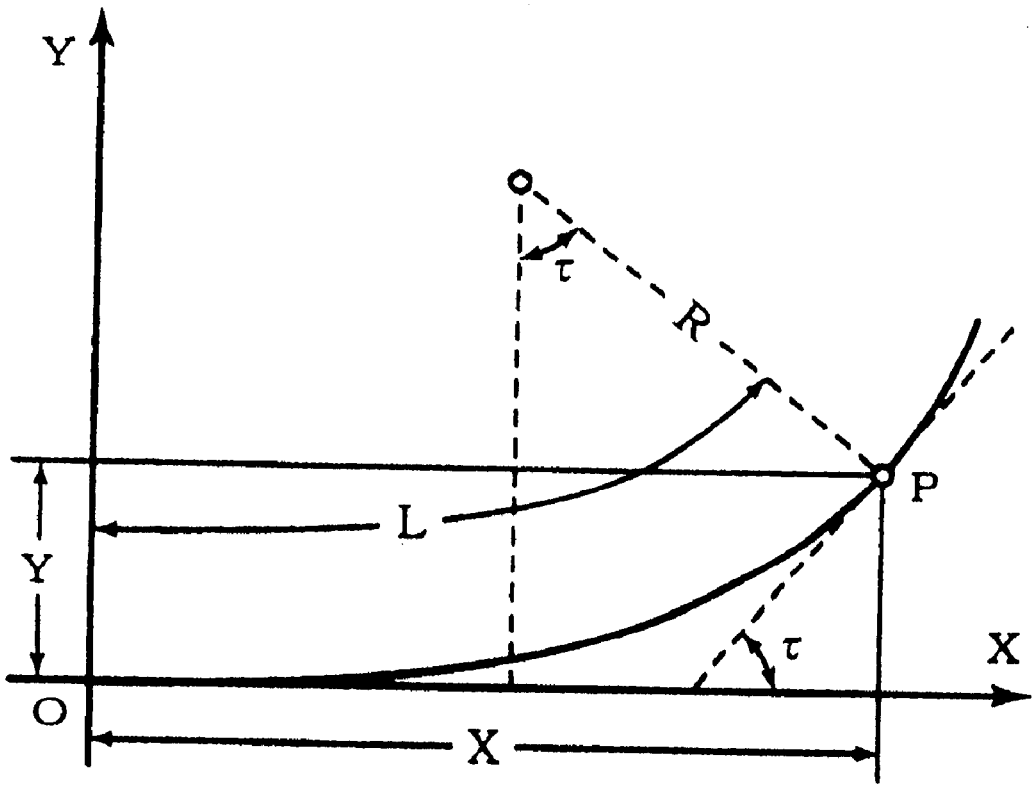
FIG. 1 (PRIOR ART)
FIG. 1 is shows a clothoid curve.

FIG. 1 shows a clothoid curve. A method for generating a clothoid curve using a computer is explained as follows. A basic equation can be expressed as $$R \times L = A^2 \quad \text{(Equation 3)}$$

where "L" is the curve length from the clothoid origin to the point "P", "R" is the radius of curvature at the point "P" and "A" is the. clothoid parameter.

According to the conventional method for designing roads, a coordinate (X, Y) at an arbitrary point, for example the point "P", is calculated using a recurrence equation of which parameters are the arc length "L" from the clothoid origin and the radius of curvature "R" at the point "P". A method for calculating the coordinate (X, Y) of the clothoid curve by using the equation (3) is explained in detail as follows.

In FIG. 1, the following three equations are formed as $$dL = R\cdot d\tau \quad \text{(Equation 4)}$$

$$dX = dL\cdot\cos\tau \quad \text{(Equation 5)}$$

$$dY = dL\cdot\sin\tau \quad \text{(Equation 6)}$$

And, eliminating "R" from the equation (3) and the equation (4), the equation (7) is formed as $$dL = \frac{A^2}{L} d\tau \quad \text{(Equation 7)}$$

And, integrating the equation (6) in the condition of "l=0" at "τ=0", the equation (8) is formed as $$L^2 = 2A^2\tau \quad \text{(Equation 8)}$$

Substituting the equation (8) into the basic equation, the equation (9) is formed as $$\tau = \frac{L^2}{2A^2} = \frac{L}{2R} \quad \text{(Equation 9)}$$

And more, the equation (10) is formed as $$R = \frac{A^2}{L} = \frac{A}{\sqrt{2\tau}} \quad \text{(Equation 10)}$$

And substituting the equation (7) into the equation (5) and the equation (6) respectively and substituting the equation (10), the equation (11) and the equation (12) are formed as $$dX = dL\cdot\cos\tau \quad \text{(Equation 11)}$$

$$= \frac{A^2}{L}\cos\tau d\tau$$

$$= \frac{A}{\sqrt{2\tau}}\cos\tau d\tau$$

$$dY = dL\cdot\sin\tau \quad \text{(Equation 12)}$$

$$= \frac{A^2}{L}\sin\tau d\tau$$

$$= \frac{A}{\sqrt{2\tau}}\sin\tau d\tau$$

And more, integrating the equation (11) and the equation (12), the equation (13) is formed as $$X = \frac{A}{\sqrt{2}} \int_0^{\tau} \frac{\cos\tau}{\sqrt{2}} dt \qquad \text{(Equation 13)}$$

$$Y = \frac{A}{\sqrt{2}} \int_0^{\tau} \frac{\sin\tau}{\sqrt{2}} dt$$

These are Fresnel integrals. The right sides of the equations can be expanded in a series and integrated numerically.

Therefore, the equation (14) and the equation (15) are formed as $$\cos\tau = 1 - \frac{\tau^2}{2!} + \frac{\tau^4}{4!} - \frac{\tau^6}{6!} + \ldots = 1 - \frac{\tau^2}{2} + \frac{\tau^4}{24} - \frac{\tau^6}{720} + \ldots \qquad \text{(Equation 14)}$$

$$\sin\tau = \tau - \frac{\tau^3}{3!} + \frac{\tau^5}{5!} - \frac{\tau^7}{7!} + \ldots = \tau - \frac{\tau^3}{6} + \frac{\tau^5}{120} - \frac{\tau^7}{5040} + \ldots$$

$$\int_0^{\tau} \frac{\cos\tau}{\sqrt{\tau}} d\tau = 2\sqrt{\tau}\left(1 - \frac{\tau^2}{10} + \frac{\tau^4}{216} - \frac{\tau^6}{9360} + \ldots\right) \qquad \text{(Equation 15)}$$

$$\int_0^{\tau} \frac{\sin\tau}{\sqrt{\tau}} d\tau = \frac{2}{3}\tau\sqrt{\tau}\left(1 - \frac{\tau^2}{14} + \frac{\tau^4}{440} - \frac{\tau^6}{25200} + \ldots\right)$$

Accordingly, the equation (13) is expressed as $$X = \frac{A}{\sqrt{2}} 2\sqrt{\tau}\left(1 - \frac{\tau^2}{10} + \frac{\tau^4}{216} - \frac{\tau^6}{9360} + \ldots\right) \qquad \text{(Equation 16)}$$

$$Y = \frac{A}{\sqrt{2}} \frac{2}{3}\tau\sqrt{\tau}\left(1 - \frac{\tau^2}{14} + \frac{\tau^4}{440} - \frac{\tau^6}{25200} + \ldots\right)$$

Substituting "R" and "L" into the equation (16), the equation (17) is formed as $$X = L\left(1 - \frac{L^2}{40R^2} + \frac{L^4}{3456R^4} - \frac{L^6}{599040R^6} + \ldots\right) \qquad \text{(Equation 17)}$$

$$Y = \frac{L^2}{6R}\left(1 - \frac{L^2}{56R^2} + \frac{L^4}{7040R^4} - \frac{L^6}{1612800R^6} + \ldots\right)$$

According to the conventional method, the coordinate (X, Y) at the point "P" of the clothoid curve is calculated by the equation (17) with using the personal computer and the like.

Figure 2:
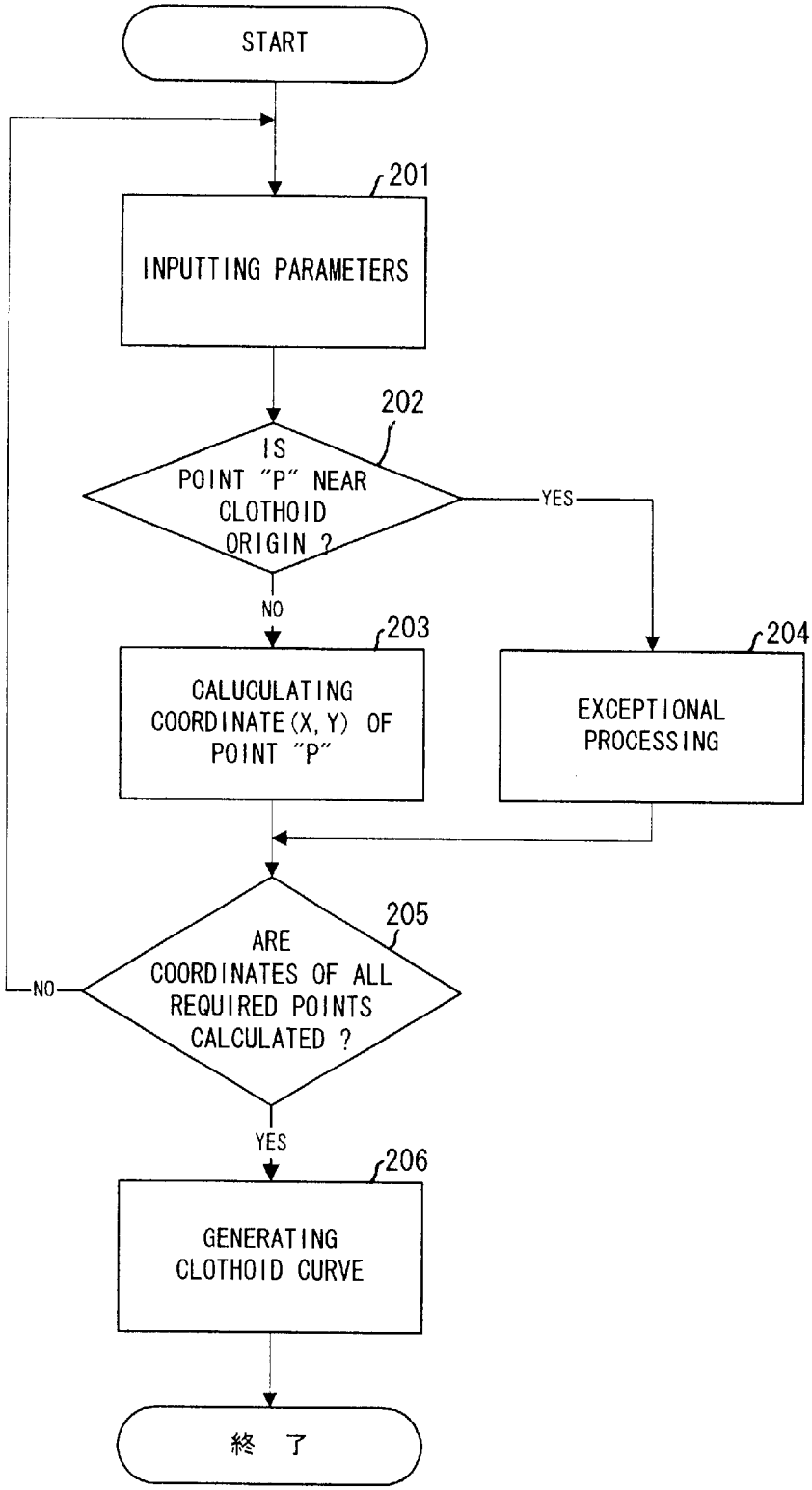
FIG. 2 (PRIOR ART)
FIG. 2 is a flowchart showing the processing for calculating a coordinate at an arbitrary point of a clothoid curve in the conventional method for designing roads.

FIG. 2 is a flowchart showing the processing for calculating a coordinate at an arbitrary point of a clothoid curve in the conventional method for designing roads. In FIG. 2, firstly, when a coordinate at an arbitrary point of the road which is an object of design is calculated, that is the coordinate (X, Y) at the point "P" described in FIG. 1 is calculated, the arc length "L" from the clothoid origin and the radius of the curvature at the point "P" are input into a personal computer as parameters (in the step 201).

Next, whether the point "P" is near the clothoid origin of the clothoid curve is checked (in the step 202).

When the point "P" is not near the clothoid origin of the clothoid curve, the coordinate (X, Y) at the point "P" is calculated by using the equation (17) (in the step 203).

On the other hand, when the point "P" is near the clothoid origin of the clothoid curve in the step 202, "L÷0" and "R÷infinite", and the calculation result of the equation (17) becomes indefinite. Therefore, exceptional processing, with which the coordinates near the clothoid origin are not calculated, is executed (in the step 204).

In the following, by repeating the processes from the step 201 to the step 204 at arbitrary points of a predetermined number (in the step 205), coordinates (X, Y) at the several points can be calculated (in the step 206).

In this manner, the coordinates (X, Y) at the several points of the clothoid curve can be calculated.

In the conventional method for designing roads using clothoid curves which are generated by the equation (17) using a computer such as a personal computer, however, there is a disadvantage in that it is necessary to execute exceptional processing, with which coordinates near clothoid origin are not calculated, because when the coordinates (X, Y) are calculated near the clothoid origin, "L÷0" and "R÷infinite", accordingly the calculation results become indefinite.

Figure 3:
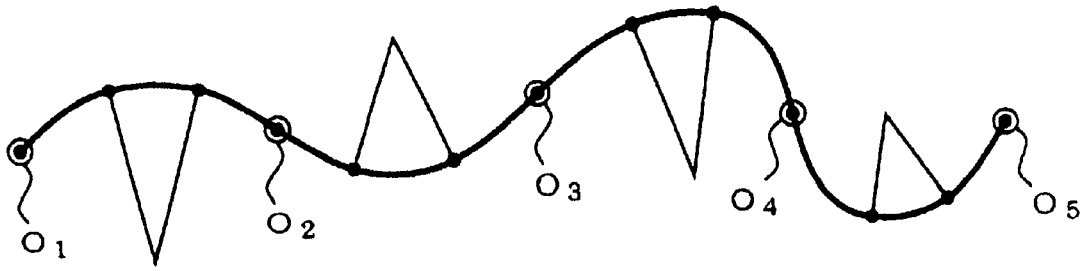
FIG. 3 (PRIOR ART)
FIG. 3 shows a compound curve formed by line segments, circular arcs and clothoid curves.
Figure 4:
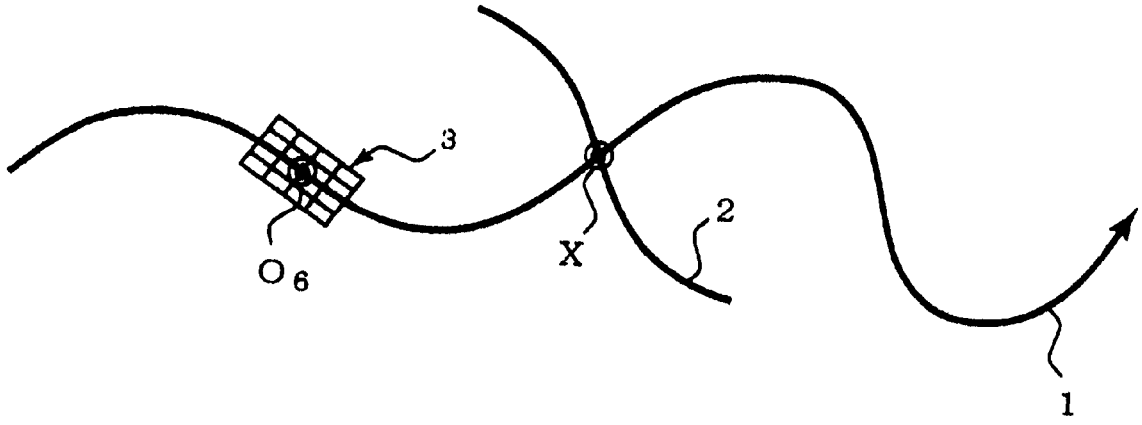
FIG. 4 (PRIOR ART)
FIG. 4 describes a method for calculating an intersection of lines.
Figure 5:
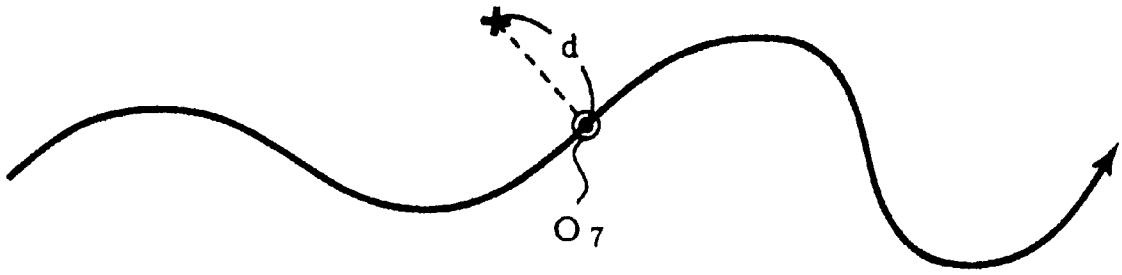
FIG. 5 (PRIOR ART)
FIG. 5 describes a method for calculating the shortest distance.

FIG. 3 shows a compound curve formed by line segments, circular arcs and clothoid curves. FIG. 4 describes a method for calculating an intersection of lines. FIG. 5 describes a method for calculating the shortest distance.

In FIG. 3, there are 5 clothoid origins ($O_1$~$O_5$), the exceptional processing is executed at these points. That is, in case of calculating a clothoid curve by the equation (17) using a personal computer, the clothoid curve can not be generated near a clothoid origin, accordingly, a road designer takes advantage of another method for generating a clothoid curve near a clothoid origin. For example, exceptional processing with which a coordinate (X, Y) is fixed (0, 0) when "L÷0" and "R÷infinite", is required besides generating circular arcs, line segments and clothoid curves. The exceptional processing causes slow execution speed and complicated processing, and obstructs unified processing by using parameters, the real length "L" of which compound curves are used as roads.

And as shown in FIG. 4, in case an intersection of roads (a curve 1 and a curve 2) which is the point X comes to near a point where the curvature varies, that means near a clothoid origin, the calculation of the intersection of the roads can not be executed because the coordinates near the clothoid origin can not be calculated. Furthermore, in case of calculating the intersection of the bridge girder 3 and the compound curve 1, the calculation of the intersection can not be executed near the clothoid origin "$O_6$" for the same reason.

Moreover, when the shortest distance d (length of a perpendicular line) from a road centerline to an arbitrary point is calculated and the perpendicular line passes near the clothoid origin "$O_7$" as described in FIG. 5, the calculation can not be executed because the coordinates near the clothoid origin is not calculated. Therefore, in such case of designing a road predetermined distance apart from a building, the road design can not be easily executed if the shortest distance can not be calculated.

In the following, a method, an apparatus and program products for designing roads according to the present invention are explained in details referring to the drawings.

An apparatus and a method for designing roads in the preferred embodiment according to the invention will be explained in FIGS. 6 to 8.

Figure 6:
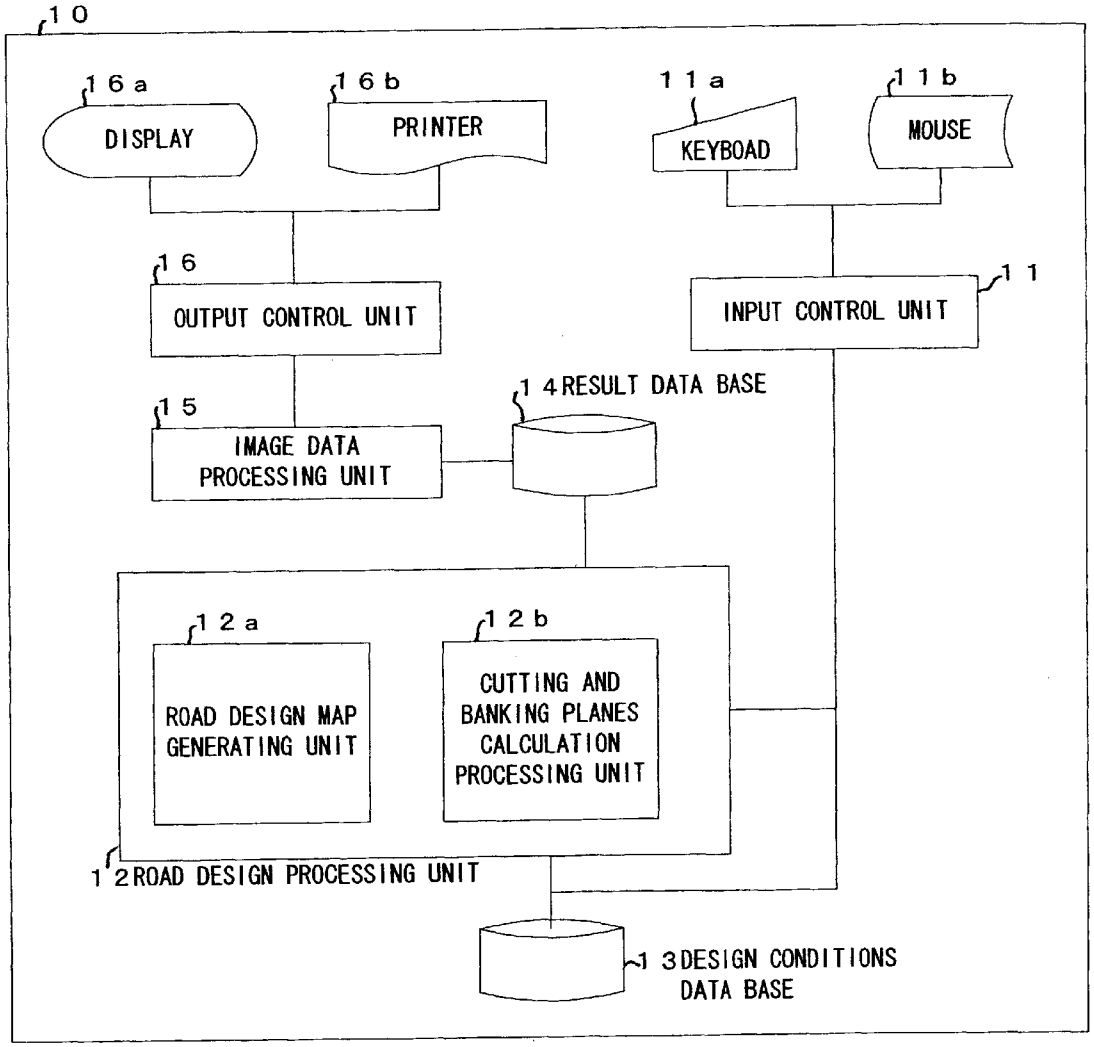
FIG. 6 is a block diagram showing an example of the apparatus for designing roads according to the present invention.

FIG. 6 is a block diagram showing an example of the apparatus for designing roads such as a CAD (Computer Aided Design) system for designing roads. In FIG. 6, the apparatus for designing roads 10 comprises an input unit such as a keyboard 11*a* and/or a mouse 11*b* for inputting information of design conditions, such as the arc length "l" from a clothoid origin at an arbitrary point on a clothoid curve and/or a clothoid parameter "A", and/or a command of design processing and so on, an input control unit 11 for controlling the input unit such as the keyboard 11*a* and/or the mouse 11*b*, a design conditions database 13 for storing data such as the information of the design conditions input by the input unit such as the keyboard 11*a* and/or the mouse 11*b*, a road design processing unit 12 for executing road design in accordance with the command of the design processing input by the input unit such as the keyboard 11*a* and/or the mouse 11*b* and/or the information of the design conditions stored in the design conditions database 13, a result database 14 for storing a data file such as a road design map generated by the road design processing unit 12, an image data processing unit 15 for converting the data file such as the road design map stored by the result database 14 into a suitable output format, an output unit for outputting the road design map converted by the image data processing unit 15 such as a display 16a for outputting the road design map as three dimensional computer graphics and/or a printer 16*b* for outputting the road design map by printer papers, and an output control unit 16 for controlling the output unit such as the display 16*a* and/or the printer 16*b*.

Then, the road design processing unit 12 comprises a road design map generating unit 12*a* for generating a road design map by generating a clothoid curve in accordance with the command of the design processing input by the input unit such as the keyboard 11*a* and/or the mouse 11*b* and/or the information of the design conditions stored by the design conditions database 13, and a cutting and banking planes calculation processing unit 12*b* for calculating a cutting plane and a banking plane in accordance with the road design map generated by the road design map generating unit 12*a*.

Next, the road design processing using the apparatus for designing roads according to the present invention will be explained as follows.

Figure 7:
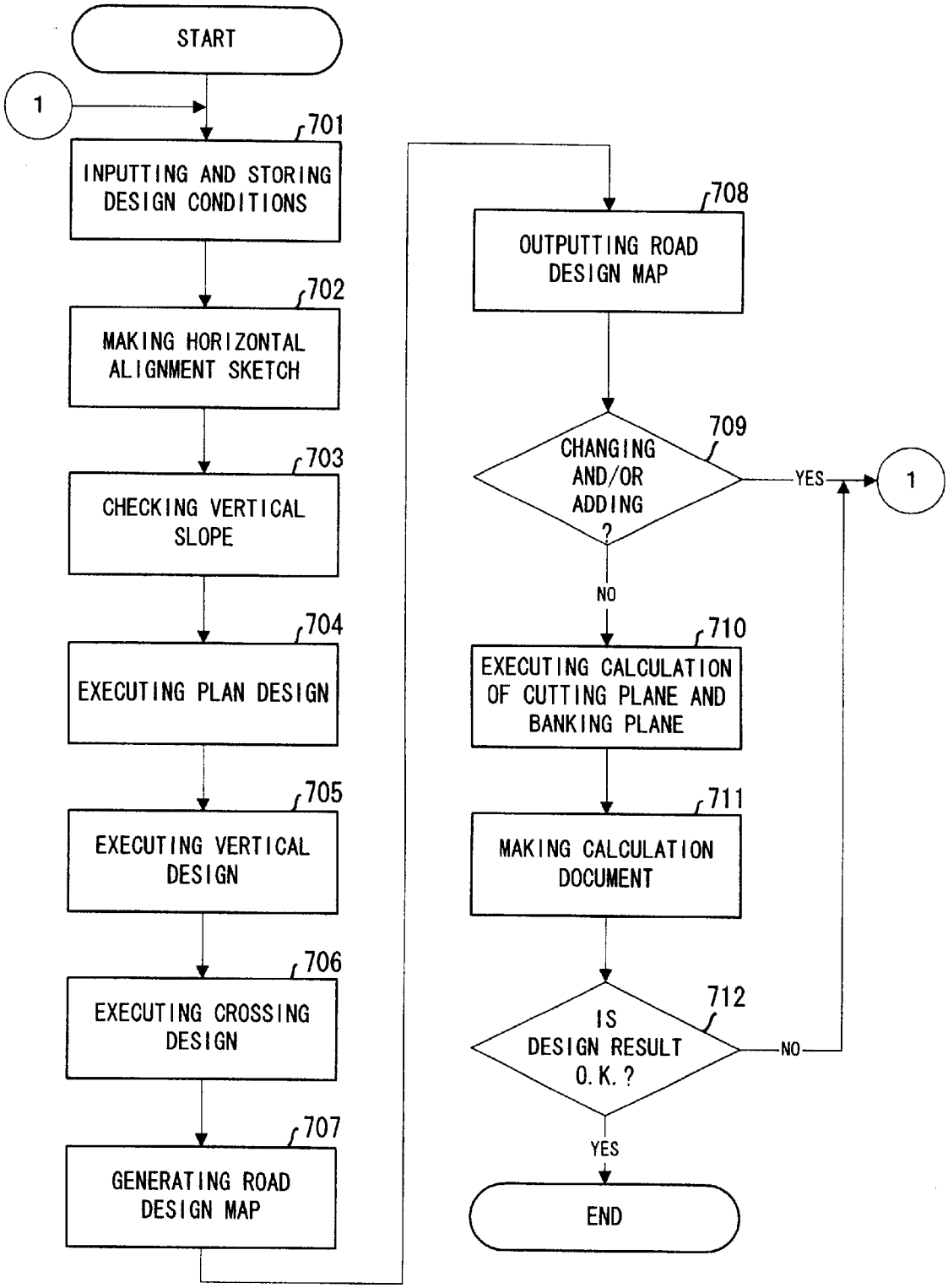
FIG. 7 is a flowchart showing the processing in the method for designing roads according to the present invention.

FIG. 7 is a flowchart showing the processing in the method for designing roads according to the present invention. In FIG. 6 and FIG. 7, firstly, information of design conditions such as a landform; structures, a road planned site, the laws and regulations, the road structure ordinance, the arc length "l" from a clothoid origin at an arbitrary point on a clothoid curve and/or a clothoid parameter "A" are input by the input unit such as the keyboard 11*a* and/or the mouse 11*b* and stored in the design conditions database 13 through the input control unit 11 (in the step 701).

Next, the road design map generating unit 12*a* of the road design processing unit 12 makes a horizontal alignment sketch at a command of design processing input by the input unit such as the keyboard 11*a* and/or the mouse 11*b* in accordance with the design conditions set in the step 701 (in the step 702). In the concrete, a road centerline sketch is made by linking each one of plane elements of roads such as straight lines, clothoids and cirlular arcs by using a personal computer. Then, taking the road centerline as a standard, a width of the road is set. In this time, whether a distance between a side of the road and a structure etc. satisfies the distance determined by the construction standard is checked. Then, the road design map generating unit 12*a* of the road design processing unit 12 calculates coordinates (X, Y) at arbitrary points on a predetermined clothoid curve and generates a road design map using the coordinates (X, Y).

The processing for calculating coordinates (X, Y) of a clothoid curve in the method for designing roads according to the present invention as follows.

Figure 8:
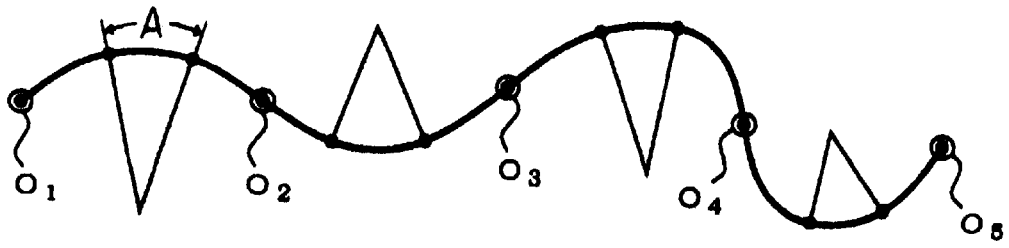
FIG. 8 shows a compound curve formed by line segments, circular arcs and clothoid curves.
Figure 8:
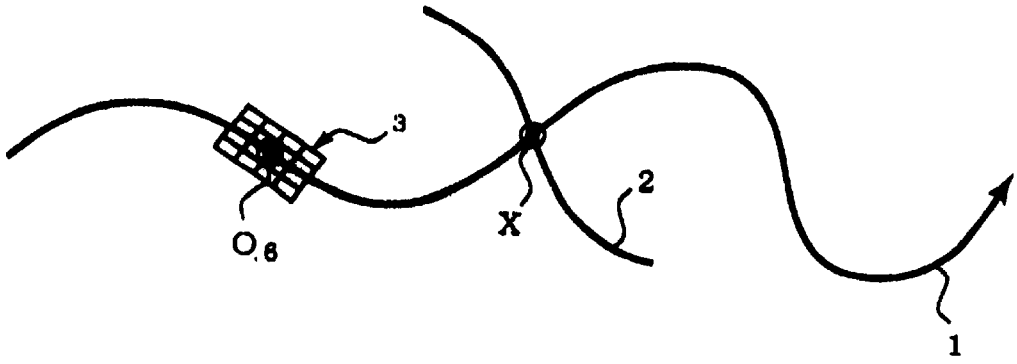
Figure 8:
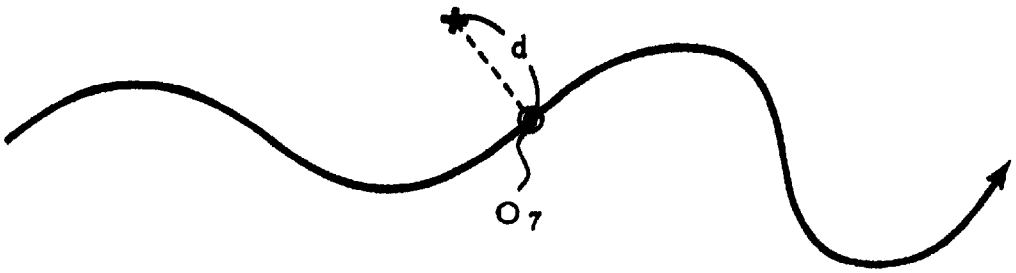

FIG. 8 shows a sketched road centerline such as line segments, circular arcs and clothoid curves. FIG. 8(A) shows a compound curve of a road centerline formed by line segments, circular arcs and clothoid curves. FIG. 8(B) describes a method for calculating an intersection of road centerlines. FIG. 8(C) describes a method for calculating the shortest distance from a road centerline to an arbitrary point. In FIG. 8(A), a clothoid curve in the condition of the clothoid parameter "A=1.0" is named the unit clothoid curve. Then, a coordinate at the unit clothoid curve is calculated. A position (x, y) of the arc length "l" from the clothoid origin "$O_1$" (0.0, 0.0) is expressed as $$x(l) = \int_0^l \cos\frac{l^2}{2}\,dl \qquad \text{(Equation 18)}$$

$$y(l) = \int_0^l \cos\frac{l^2}{2}\,dl$$

where "$l \geqq 0.0$".

Then, using the well-known series expansion of trigonometric function expressed as $$\cos\theta = 1 - \frac{\theta^2}{2!} + \frac{\theta^4}{4!} - \frac{\theta^6}{6!} + \ldots + (-1)^n\frac{\theta^{2n}}{(2n)!} + \ldots \qquad \text{(Equation 19)}$$

$$\sin\theta = \theta - \frac{\theta^3}{3!} + \frac{\theta^5}{5!} - \frac{\theta^7}{7!} + \ldots + (-1)^n\frac{\theta^{2n+1}}{(2n+1)!} + \ldots$$

and then, the equation (18) is expressed as $$x = l - \frac{l^5}{5\cdot 2^2\cdot 2!} + \frac{l^9}{9\cdot 2^4\cdot 4!} - \frac{l^{13}}{13\cdot 2^6\cdot 6!} + \ldots + (-1)^n\frac{l^{4n+1}}{(4n+1)\cdot 2^{2n}\cdot(2n)!} + \ldots \qquad \text{(Equation 20)}$$

$$y = \frac{l^3}{3\cdot 2} - \frac{l^7}{7\cdot 2^3\cdot 3!} + \frac{l^{11}}{11\cdot 2^5\cdot 5!} - \frac{l^{15}}{15\cdot 2^7\cdot 7!} + \ldots + (-1)^n\frac{l^{4n+3}}{(4n+3)\cdot 2^{2n+1}\cdot(2n+1)!} + \ldots$$

Then, the equation (20) is rewritten as $$x = \sum_{n=0}^{\infty}(-1)^n\frac{l^{4n+1}}{(4n+1)\cdot 2^{2n}\cdot(2n)!} \qquad \text{(Equation 21)}$$

$$y = \sum_{n=0}^{\infty}(-1)^n\frac{l^{4n+3}}{(4n+3)\cdot 2^{2n+1}\cdot(2n+1)!}$$

As explained in the equation (21), a clothoid curve according to the present invention can be generated by an expansion of only the arc length "l". And, it is clear that the calculation results never become indefinite near the clothoid origins, that is to say, in case the arc length "l" is near the points "$O_1$"~"$O_5$". Therefore, the exceptional processing which has been executed in the conventional method becomes unnecessary near the clothoid origins. Also, the clothoid curve according to the present invention has highly affinity and compatibility with the conventional method and is usable because the only arc length "l" from the clothoid origin can be set as parameters.

When a recurrence equation in which the only arc length "l" of the clothoid curve is a parameter is used by a CAD (Computer Aided Design) system for designing roads, a compound curve formed by circular arcs, line segments and clothoid curves can be handled as one simply smooth curve easily by setting the real length of the road (arc length) as a parameter. And also, the processing speed is rapid because the exceptional processing is not necessary, accordingly the road design can be executed efficiently.

In an actual program, a clothoid curve is generated using the relation equation (22) of a "n" term (Tx(n), Ty(n)), which is deduced by expanding "x" and "y" of the equation (21) in a series, expressed as $$Tx(n+1) = -\frac{(4n+1)\cdot l^4}{4\cdot(4n+5)\cdot(2n+2)\cdot(2n+1)}Tx(n) \quad (n = 0, 1, 2, \ldots) \qquad \text{(Equation 22)}$$

$$Tx(0) = l$$

$$Ty(n+1) = -\frac{(4n+3)\cdot l^4}{4\cdot(4n+7)\cdot(2n+3)\cdot(2n+2)}Ty(n) \quad (n = 0, 1, 2, \ldots)$$

$$Ty(0) = \frac{l^3}{3\cdot 2}$$

Also, in case of executing the calculation of an intersection of two roads, the calculation of the intersection "X" on the curve can be executed as described in FIG. 8(B) even though the intersection "X" is near the point where the curvature varies, that is to say, near a clothoid origin, because the compound curve according to the present invention is formed by one curve.

And more, in case of executing the calculation of the shortest distance "d" from a road centerline to an arbitrary point (a calculation of a perpendicular line), the calculation of the shortest distance can be executed as described in FIG. 8(C) even though the perpendicular line from the arbitrary point passes near the clothoid origin (the point "$O_7$"). Accordingly, in such case of designing a road predetermined distance apart from a building, the road design can be executed efficiently.

After making the horizontal alignment sketch as explained in the above, a vertical slope is checked in accordance with difference of elevation of the road and/or the landform and so on (in the step 703).

After that, plan design such as the fixation of a horizontal alignment of a road, the fixation of a nose, the construction of a road width, a ramp station and a standard crossing composition is executed (in the step 704).

And, the configuration of a vertical section of the road (a straight line and/or a parabola, etc.) is decided and vertical design such as the entry (input) of the landform and/or the control, the entry of a crossing position with a main road, the check of whether it is obtained a clearance at each condition in the horizontal direction, the check of the slope in the part of the nose and the decision of a vertical alignment is executed (in the step 705).

Then, a crossing landform is read out and crossing design such as a pavement, the placement of a road base and a road body, the placement of a soft shoulder, a slope finishing installation, the placement of structures such as a retaining wall and/or a pier, the placement of a side road and/or a ramp, a phase 1 planning is executed (in the step 706).

Furthermore, design of a slope finishing expansion and drainage such as the setting of a slope finishing expansion and drainage and the starting of the structures is executed, and a road design map is automatically generated (in the step 707).

The road design map generated in this way is converted into a suitable format by the image data processing unit 15 and output to the display 16*a* and/or the printer 16*b* through the output control unit 16, and checked (in the step 708).

If it is not necessary for the generated road design map to be changed and/or to be added (in the step 709), the cutting and banking planes calculating processing by the cutting and banking planes calculation processing unit 12*b* is executed (in the step 710). On the other hand, if it is necessary for the generated road design map to be changed and/or to be added (in the step 709), the processing from the above-mentioned step 701 is repeated.

In the cutting and banking planes calculation processing unit 12*b*, a calculation of an end of a slope finishing of the cutting and banking planes is executed in accordance with the road design map generated by the road design map generating unit 12*a* (in the step 710).

Then, the calculation document such as the calculation of a quantity of cutting and banking, the calculation of a quantity of slope finishing processes, and an extended record and/or a mass curve is made (in the step 711).

Finally, each design result is output as three dimensional computer graphics on the screen of the display 16*a* and checked (in the step 712). If there is no problem, the road design is finished. On the other hand, if there is inexpedience and/or failure, the processing from the step 701 is started over again.

Although the invention has been described in its preferred form with a certain degree of particularity, it is understood that the present disclosure of the preferred form has been changed in the details of construction and the combination and arrangement of parts may be resorted to without departing from the spirit and the scope of the invention as hereinafter claimed.

What is claimed is:

1. An apparatus for designing roads, which is an apparatus for designing roads using line segments, circulararcs, clothoid curves and so on, comprising:

input means for inputting information of design conditions and/or a command of design processing;

design conditions storage means for storing said information of the design conditions input by said input means;

road design processing means for executing road design in accordance with said command of the design processing input by said input means and/or said information of the design conditions stored in said design conditions storage means and for generating a road design map; and output means for outputting said road design map generated by said road design processing means, wherein said road design processing means generates a clothoid curve from a clothoid origin without executing exceptional processing near said clothoid origin in case of generating a curvature transition curve of a road using said clothoid curve, by calculating coordinates of said clothoid curve using the following recurrence equation (1), of which parameters are only the arc length "l" from said clothoid origin, expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

2. The apparatus for designing roads of claim 1, wherein said road design processing means generates a clothoid curve using the following relation equation (2) of a "n"

term (Tx(n), Ty(n)), which is deduced by expanding "x" and "y" of said recurrence equation (1) in a series, expressed as $$Tx(n+1) = -\frac{(4n+1)\cdot l^4}{4\cdot(4n+5)\cdot(2n+2)\cdot(2n+1)}Tx(n) \quad (n = 0, 1, 2, \ldots) \qquad \text{(Equation 2)}$$

$$Tx(0) = l$$

$$Ty(n+1) = -\frac{(4n+3)\cdot l^4}{4\cdot(4n+7)\cdot(2n+3)\cdot(2n+2)}Ty(n) \quad (n = 0, 1, 2, \ldots)$$

$$Ty(0) = \frac{l^3}{3\cdot 2}.$$

3. The apparatus for designing roads of claim 1 comprises a computer aided design system for designing roads.

4. An apparatus for designing roads, which is an apparatus for designing roads using line segments, circular arcs, clothoid curves and so on, comprising:

input means for inputting information of design conditions and/or a command of design processing;

design conditions storage means for storing said information of the design conditions input by said input means;

road design processing means for executing road design in accordance with said command of the design processing input by said input means and/or said information of the design conditions stored in said design conditions storage means and for generating a road design map;

result storage means for storing said road design map generated by said road design processing means; and output means for outputting said road design map stored by said result storage means, wherein said road design processing means generates a clothoid curve from a clothoid origin without executing exceptional processing near said clothoid origin in case of generating a curvature transition curve of a road using said clothoid curve, by calculating coordinates of said clothoid curve using the following recurrence equation (1), of which parameters are only the arc length "l" from said clothoid origin, expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

5. A method for designing roads comprising, the steps of:

(A) storing input information of design conditions;

(B) executing toad design in accordance with an input command of design processing and/or the stored information of the design conditions and generating a road design map using line segments, circular arcs, clothoid curves and so on; and (C) outputting the generated road design map, wherein said step (B) carries out generating a clothoid curve from a clothoid origin without executing exceptional processing near the clothoid origin in case of generating a curvature transition curve of a road using the clothoid curve, by calculating coordinates of the clothoid curve using the following recurrence equation (1), of which parameters are only the arc length "l" from the clothoid origin expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

6. The method for designing roads of claim 5, wherein said step (B) generates a clothoid curve using the following relation equation (2) of a "n" term (Tx(n), Ty(n)), which is deduced by expanding "x" and "y" of said recurrence equation (1) in a series, expressed as $$Tx(n+1) = -\frac{(4n+1)\cdot l^4}{4\cdot(4n+5)\cdot(2n+2)\cdot(2n+1)}Tx(n) \quad (n = 0, 1, 2, \ldots) \qquad \text{(Equation 2)}$$

$$Tx(0) = l$$

$$Ty(n+1) = -\frac{(4n+3)\cdot l^4}{4\cdot(4n+7)\cdot(2n+3)\cdot(2n+2)}Ty(n) \quad (n = 0, 1, 2, \ldots)$$

$$Ty(0) = \frac{l^3}{3\cdot 2}.$$

7. The method for designing roads of claim 5 is applied to a computer aided design system for designing roads.

8. A method for designing roads comprising, the steps of:

(A) storing input information of design conditions;

(B) executing road design in accordance with an input command of design processing and/or the stored information of the design conditions and generating a road design map using line segments, circular arcs, clothoid curves and so on;

(C) storing the generated road design map; and (D) outputting the stored road design map, wherein said step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty}(-1)^n\frac{l^{4n+1}}{(4n+1)\cdot 2^{2n}\cdot(2n)!} \qquad \text{(Equation 1)}$$

$$y = \sum_{n=0}^{\infty}(-1)^n\frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

9. Program products for designing roads, which is executed by computer system, comprising the steps of:

(A) storing input information of design conditions;

(B) executing road design in accordance with an input command of design processing and/or the stored information of the design conditions and generating a road design map using line segments, circular arcs, clothoid curves and so on; and (C) outputting the generated road design map, wherein said step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty} (-1)^n \frac{l^{4n+1}}{(4n+1)\cdot 2^{2n}\cdot(2n)!} \quad \text{(Equation 1)}$$

$$y = \sum_{n=0}^{\infty} (-1)^n \frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

10. The program products for designing roads of claim 9, wherein said step (B) generates a clothoid curve using the following relation equation (2) of a "n" term (Tx(n), Ty(n)), which is deduced by expanding "x" and "y" of said recurrence equation (1) in a series, expressed as $$Tx(n+1) = -\frac{(4n+1)\cdot l^4}{4\cdot(4n+5)\cdot(2n+2)\cdot(2n+1)} Tx(n) \quad \text{(Equation 2)}$$

$$(n = 0, 1, 2, \ldots)$$

$$Tx(0) = l$$

$$Ty(n+1) = -\frac{(4n+3)\cdot l^4}{4\cdot(4n+7)\cdot(2n+3)\cdot(2n+2)} Ty(n)$$

-continued $$(n = 0, 1, 2, \ldots)$$

$$Ty(0) = \frac{l^3}{3\cdot 2}.$$

11. The program products for designing roads of claim 9 is applied to a computer aided design system for designing roads.

12. Program products for designing roads, which is executed by computer system, comprising the steps of:

(A) storing input information of design conditions;

(B) executing road design in accordance with an input command of design processing and/or the stored information of the design conditions and generating a road design map using line segments, circular arcs, clothoid curves and so on;

(C) storing the, generated road design map; and (D) outputting the stored roaddesign map, wherein said step (B) carries out generating a clothoid curve from a clothoid origin without executing exceptional processing near the clothoid origin in case of generating a curvature transition curve of the road using the clothoid curve, by calculating coordinates of the clothoid curve using the following recurrence equation (1), of which parameters are only the arc length "l" from the clothoid origin, expressed as $$x = \sum_{n=0}^{\infty} (-1)^n \frac{l^{4n+1}}{(4n+1)\cdot 2^{2n}\cdot(2n)!} \quad \text{(Equation 1)}$$

$$y = \sum_{n=0}^{\infty} (-1)^n \frac{l^{4n+3}}{(4n+3)\cdot 2^{2n+1}\cdot(2n+1)!}$$

where "l" is the unit clothoid arc length, "x" and "y" is a coordinate of the arc length "l" from a clothoid origin of the unit clothoid curve, and "n" is order.

* * * * *